United States Patent [19]

Huber et al.

[11] Patent Number: 4,997,610

[45] Date of Patent: Mar. 5, 1991

[54] PROCESS FOR PRODUCING FILAMENTS AND FIBERS OF ACRYLIC POLYMERS WHICH CONTAIN CARBOXYL GROUPS

[75] Inventors: Bernd Huber, Wiesbaden; Ernst Schubert, Kelheim Donau; Heinz-Paul Pöter, Mitterfecking, all of Fed. Rep. of Germany

[73] Assignee: Hoechst Aktiengesellschaft, Frankfurt am Main, Fed. Rep. of Germany

[21] Appl. No.: 494,875

[22] Filed: Mar. 8, 1990

Related U.S. Application Data

[60] Continuation of Ser. No. 282,881, Dec. 9, 1988, abandoned, which is a continuation of Ser. No. 13,143, Feb. 11, 1987, abandoned, which is a continuation of Ser. No. 668,694, Nov. 6, 1984, abandoned, which is a division of Ser. No. 301,410, Sep. 11, 1981, abandoned.

[30] Foreign Application Priority Data

Sep. 13, 1980 [DE] Fed. Rep. of Germany ..... 3034635

[51] Int. Cl.[5] ..... D01F 6/18

[52] U.S. Cl. ..... 264/176.1; 264/182; 264/206

[58] Field of Search ..... 264/182, 206, 176.1; 526/341, DIG. 730

[56] References Cited

U.S. PATENT DOCUMENTS

| | | | |
|---|---|---|---|
| 2,721,113 | 10/1955 | Downing et al. | 264/182 |
| 2,806,010 | 9/1957 | Wheatley et al. | 264/182 |
| 3,458,060 | 1/1976 | Reinehr et al. | 264/206 |
| 3,733,386 | 5/1973 | Shimoda et al. | 264/182 |
| 4,143,200 | 3/1979 | Radlmann et al. | 264/206 |

FOREIGN PATENT DOCUMENTS

| | | | |
|---|---|---|---|
| 0612989 | 1/1961 | Canada | 264/182 |
| 1050718 | 3/1979 | Canada . | |
| 1119457 | 6/1960 | Fed. Rep. of Germany | 264/182 |
| 1266925 | 4/1968 | Fed. Rep. of Germany | 264/182 |
| 1807781 | 6/1969 | Fed. Rep. of Germany | 264/182 |
| 2426675 | 12/1975 | Fed. Rep. of Germany | 264/206 |
| 1353521 | 12/1962 | France | 264/182 |
| 0139510 | 8/1982 | Japan | 264/182 |
| 1416807 | 12/1975 | United Kingdom . | |
| 1416808 | 12/1975 | United Kingdom . | |
| 1416809 | 12/1975 | United Kingdom . | |
| 1416810 | 12/1975 | United Kingdom . | |
| 1447536 | 8/1976 | United Kingdom . | |

*Primary Examiner*—Hubert C. Lorin

*Attorney, Agent, or Firm*—Curtis, Morris & Safford

[57] ABSTRACT

A fiber or filament of a swellable polymer of high tensile strength is made by spinning a polymeric raw material which is produced by agitating a suspension of solid particles of an acrylonitrile polymer in dilute sulfuric acid having an acid concentration between 40 to 50 percent by weight until the polymer is hydrolyzed to an extent that it contains from 10 to 30 percent by weight of carboxyl groups such that sticking of individual particles of the polymer to one another is avoided.

5 Claims, No Drawings

PROCESS FOR PRODUCING FILAMENTS AND FIBERS OF ACRYLIC POLYMERS WHICH CONTAIN CARBOXYL GROUPS

This application is a continuation of application Ser. No. 07/282,881, filed Dec. 9, 1989, now abandoned, which is a continuation of Ser. No. 013,143, filed Feb. 11, 1987, now abandoned, which is a continuation of Ser. No. 668,694 filed Nov. 6, 1984 and now abandoned, which is in turn a division of Ser. No. 301,410 filed Sept. 11, 1981 and now abandoned.

The present invention relates to filaments and fibers and to a process for their production. The filament-forming substance of said filaments or fibers contains an acrylic polymer in addition to acrylonitrile units and other units copolymerizable with acrylonitrile such as acrylic acid and/or methacrylic acid radicals and, if suitable, acrylamide building units.

The carboxyl group content of the filaments and fibers according to the invention is 10–30, preferably 15–26% by weight. The fibers and filaments according to the invention can be obtained from corresponding polymeric raw materials by the spinning methods customary for polyacrylonitrile and are distinguished by good textile-technological properties, particularly with respect to the tensile and knot strength, which permit problem-free further processing, for example into textile sheet structures. The textile-technological properties of a fiber or a filament can be described as good, if they achieve the level of wool.

Filaments and fibers of acrylic polymers which contain relatively small amounts of carboxyl groups are known. For example, German Offenlegungsschrift No. 2,434,232 describes a process for the production of acrylic fibers with improved hygroscopicity, in which raw materials which contain carboxyl groups are spun into fibers, the fibers are stretched, the fiber-forming substance is subsequently crosslinked and the carboxyl groups are converted into the corresponding salt form in an aqueous alkaline medium. In the examples, polymers with up to 12% of acrylic acid (corresponding to 7.5% of carboxyl groups) or 15% of methacrylic acid (corresponding to 7.8% of carboxyl groups) are used. Such filaments can take up only a small amount of water, because of the crosslinking reactions carried out.

German Offenlegungsschriften Nos. 2,337,505, 2,335,696, 2,335,697 and 2,336,036 described processes for the production of acrylonitrile-acrylamide mixed polymers by hydrolysis of acrylonitrile copolymers using concentrated acids in a homogeneous phase system. They stress that the dissolving of the acrylonitrile polymers which are to be hydrolyzed should be as rapid as possible and that the hydrolysis should take place in a homogeneous phase system in order to improve the quality of the products obtained. It was found that any heterogeneity has a detrimental effect on the quality of the products obtained. In these prior publications, hydrolysis of the acrylonitrile groups is always carried out with concentrated acids by which the formation of carboxyl groups is negligibly small.

The effect of concentrated acids on acrylonitrile polymers is also described in "Faserforschung und Textiltechnik" 11 (1960), pages 362 and 363.

"Faserforschung und Textiltechnik" 14 (1963), pages 265 to 270, describes fibers of mixtures of polyacrylonitrile and homogeneously hydrolyzed polyacrylonitrile. However, attention is already being drawn to the strong gelling tendency of the spinning solutions prepared from mixtures with a carboxyl group content of 8.5%, such spinning solutions making the spinning process noticeably more difficult.

The task, therefore, remained, of producing filaments and fibers of acrylic polymers of high carboxyl group content, which could be processed into textile structures or wadding type or cotton wool-like structures.

It has now been found, surprisingly, that it is possible to spin polyacrylonitrile with a carboxyl group content of up to 30% by weight, which has been hydrolyzed with the aid of dilute acids in a heterogeneous phase system, according to the spinning methods customary for polyacrylonitrile. The heterogenous phase system is a suspension of solid polymer particles in aqueous sulfuric acid. Since such a system contains two phases, namely a solid and a liquid phase, it is heterogenous. The filaments and fibers so obtained can be crimped and carded without problems and can be processed into waddings, yarns and textile sheet structures. Conversion of blends with other fibers is also possible without difficulty. Values important for further processing, such as the tensile strength and knot strength, correspond to or exceed the values known for wool. They exhibit, in the dry state, tensile strengths of more than 10 cN/tex and knot strengths of more than 6 cN/tex, preferably even 8 or more cN/tex.

The filaments or fibers according to the invention are particularly suitable for conversion in the form of blends with other fibers for the production of yarns for cloting textiles with increased wear comfort, because of the swellability which can be set by the carboxyl group content and the high water retention connected with it. Absorbent waddings, nonwovens, tampons, woven fabrics, knitted fabrics and the like, which are distinguished by their remarkable water retention, can be produced from the filaments and fibers according to the invention, particularly when processed on their own and not in blends. If such filaments or fibers or structures formed from such products according to the invention are treated with gaseous or anhydrous bases, then the carboxyl groups can be converted into the salt form. The swellability of the filaments and fibers can be increased several fold, without the filaments sticking to one another or becoming brittle, by such methods which are the subject of a parallel application.

The filaments and fibers according to the invention and the structures produced therefrom swell extensively when in contact with alkaline aqueous media. These properties make possible, for example, the production of filter fabrics, which permit the passage of acid aqueous media but bar alkaline aqueous media. The filaments and fibers according to the invention and the structures produced therefrom are also outstandingly suitable for use as ion exchange media of very high exchange capacities.

The invention is also based on a process for the production of such filaments and fibers, wherein the fiber raw material is produced by hydrolysis of an acrylonitrile polymer or acrylonitrile copolymer using aqueous dilute acids in a heterogeneous phase system. The desired degree of hydrolysis can be set exactly, for example by varying the concentration of the acid applied while keeping the reaction conditions constant in other respects. Preferably only carboxyl groups result from the heterogeneous hydrolysis using dilute aqueous acids in contrast to the homogeneous hydrolysis reactions of polyacrylonitriles with higher concentrations of acid.

The non-uniformity of the polymers, particularly with respect to the distribution of sequences, could well be considerably greater for products which have been hydrolyzed heterogeneously than for the polyacrylonitriles which have been hydrolyzed homogeneously. However, the suspected greater non-uniformity of the hydrolysis products is possibly the reason for their better processability into filaments and fibers.

Hydrolysis of the nitrile groups can preferably be carried out with the aid of dilute sulfuric acid, which should have a concentration of 40 to 50, preferably 45 to 49% by weight, as well as nitric acid and phosphoric acid. The polymers are added to the acid and the mixture is stirred for a few hours. Working at the boil is recommended in order to keep the reaction times short. Reaction times of 2.5 hours are usually sufficient. Subsequently the polymer is filtered off, washed and dried. It was found that the use of dilute acids for carrying out the hydrolysis reaction is important for still another reason. Suitable hydrolysis products can only be obtained if the hydrolysis reaction is carried out in a heterogeneous phase system. However, a number of acids become, at higher concentrations, solvents or swelling agents for the polymer which is to be hydrolyzed. Such concentrations are therefore to be avoided. The highest acid concentration still suitable is the one at which the polymer particles which have been added to the aqueous acid are just short of sticking to one another. On the other hand, a small amount of swelling can in general be tolerated.

Suitable polymeric raw materials for the hydrolysis are homopolymers and copolymers of acrylonitrile, possible copolymers being for example: acrylamide, acrylic acid and its esters, vinyl esters and vinyl ethers such as vinyl acetate, vinyl stearate, vinyl butyl ether and vinyl halogenoacetates, such as vinyl bromoacetate, vinyl dichloroacetate and vinyl trichloroacetate, styrene, maleic imide, vinyl halides such as, for example, vinyl chloride, vinylidene chloride and vinyl bromide, and unsaturated compounds carrying sulfonate groups.

The process is particularly economical, if it is possible to subject to hydrolysis the fiber raw material which is produced on a large scale for the spinning of conventional acrylic fibers. The comonomers employed there can have an advantageous influence on the rate of hydrolysis, as is known from the case of acrylamide.

The hydrolyzed, dried polymer is dissolved in the solvents customary for polyacrylonitrile in order to prepare spinning solutions and is then spun by using the dry or wet spinning process according to customary methods. The filaments drawn off from the spinning jet can be stretched in the wet state before, after or during the washing stage. After finishing, they are dried, it being possible to permit some shrinkage during drying. In general, drying is followed by a further stretching procedure in the dry-hot state. Subsequently, shrinkage can again take place in order to lower the boil-off shrinkage. When producing fibers, the tows obtained are then usually crimped and cut to the desired length. If necessary or desired, the filaments or fibers according to the invention can also be subjected to a pressure steaming.

In order to suppress a possible slight swelling of the filaments during the spinning process in the case of highly hydrolyzed polymers, organic solvents which are miscible with the polymer solvent, such as, for example, alcohols or ketones, can be used instead of water in the coagulation, stretching and washing baths.

The following examples are intended to illustrate the invention further. Unless otherwise indicated, the values in percentages and parts refer to amounts by weight.

EXAMPLE 1

700 g of a polymer composed of 93.7% by weight of acrylonitrile, 5.8% of methyl acrylate and 0.5% of sodium methallylsulfonate, with a relative viscosity of 1.92, measured in a 0.5% strength solution in dimethylformamide, were boiled for 2.5 hours under reflux in 2,800 g of 48.2% strength sulfuric acid (density 1.378 g/ml at 20° C.). After cooling, the polymer was washed until free of sulfate and dried.

In order to determine the carboxyl group content, about 150 mg of the polymer were dissolved in 25 ml of dimethylsulfoxide (DMSO), 60 ml of water were added and a potentiometric titration was carried out using 0.1N sodium hydroxide solution. The caustic soda factor was determined with oxalic acid, which had been dissolved in 60 ml of water to which 25 ml of DMSO had been added. The titration resulted in a carboxyl group content of 25.5% by weight (with respect to —COOH), this corresponds to an acrylic acid content of 40.7% by weight in the polymer, being ascribed to the polymer described above.

600 g of the polymer so hydrolyzed were dissolved in 1,900 g of dimethylformamide (DMF) to form a 24% strength spinning solution, the solution was then filtered and forced at a feed rate of 17.1 ml/min through a 300-hole-jet, hole diameter 0.06 mm, into a coagulation bath, having a composition of 24.5% of DMF, 75% of water and 0.5% of acetic acid and a temperature of 35° C. After an immersed length of 50 cm the filament was drawn off the jet at a speed of 6.9 m/min, stretched in a bath of 40% of DMF and 60% of water at 55° C. by raising the speed to 20.3 m/min, stretched in a further bath which contained water at 35° C. by raising the speed to 23.3 m/min, washed in water at 50° C. and was stretched again by raising the speed to 26.1 m/min. After passage through an ethanolic finishing bath, the yarn was predried on a duo at a temperature of 120° C., shrinkage being permitted by reducing the speed by 1.3 m/min, and dried fully on a further duo at a temperature of 165° C. The yarn was stretched between the two duos by raising the speed to 35.0 m/min. The yarn was drawn off the second duo at a speed of 48.5 m/min and allowed to shrink in a hot-air chamber at 155° C. by reducing the speed to 47.0 m/min.

After crimping and cutting, the fibers could be processed into a worsted yarn. Similarly, a wadding was produced by repeated carding. The material could be processed, without disruptions, into these shaped structures by the use of customary textile machinery.

The textile-technological properties of the filaments so obtained are described in the following, together with the results of Examples 2 to 6.

EXAMPLES 2 TO 6

The polymer according to Example 1 was hydrolyzed as described in the previous example. However, concentrations of the sulfuric acid were varied. The following polymers were obtained.

| Example No. | Concentration of $H_2SO_4$ % | Carboxyl group content % |
|---|---|---|
| 2 | 47.3 | 18.4 |

-continued

| Example No. | Concentration of $H_2SO_4$ % | Carboxyl group content % |
|---|---|---|
| 3 | 46.2 | 15.4 |
| 4 | 45.3 | 11.9 |
| 5 (comparison) | 50.0 | 37.6 |
| 6 (comparison) | 40.0 | 3.3 |

The hydrolyzed polymers of Examples 2 to 4 were dissolved in DMF to give 24% strength spinning solutions and were then forced through a 300-hole-jet at a feed rate of 15 ml/min into a coagulation bath corresponding to Example 1. The filaments were drawn off the jet with a speed of 5.0 m/min and stretched in a bath of 40% of DMF and 60% of water at 60° C. by raising the speed to 20.3 m/min and were stretched in a subsequent waterbath at 60° C. by raising the speed to 48.5 m/min. After washing and passage through an aqueous finishing bath, the filaments were predried on a duo at 150° C. and were fully dried on a second duo at 175° C., drawn off using a third duo and wound up after passage through a hot-air chamber at 155° C. The individual velocities of the duos are recorded in the table below.

| Example | Peripheral velocities in m/min | | | |
|---|---|---|---|---|
| | Duo 1 | Duo 2 | Duo 3 | Winder |
| 2 | 28.4 | 33.4 | 43.0 | 40.1 |
| 3 | 28.5 | 33.4 | 39.1 | 40.1 |
| 4 | 28.9 | 31.8 | 42.5 | 40.0 |
| 6 | 28.5 | 34.0 | 53.0 | 44.1 |

The polymer resulting from Example 5 could not be spun under the given conditions. The yarn had swollen too extensively, it broke frequently due to its own weight and was too strongly stuck together after drying.

The polymer resulting from Experiment No. 6 was spun as described in Examples 2 to 4, except that the two stretch baths had been heated to 75 rather than 60° C.

The denier, the tensile strength, the water retention in deionized water and the liquid retention in 0.1N sodium hydroxide solution were measured on the yarns of Examples 1 to 6. The knot strengths were determined on single filaments.

In order to determine the water retention or liquid retention, in each case about 500 mg of cut filaments were weighed into a round beaker made of polytetrafluoroethylene, the open bottom of which had been fitted with a fine-mesh gauze of V4a stainless steel. The inner diameter of the beaker was 1.8 cm and the height, measured from the gauze, was 3.9 cm. The beakers with their contents were kept for 1 hour in deionized water or an aqueous 0.1N sodium hydroxide solution, 1 g/l of a wetting agent having been added to the liquids in each case. A suitable wetting agent is the sodium salt of diisobutylnapthalenesulfonic acid. At the beginning of the liquid treatment the samples were subjected to vacuum for 5 minutes in order to remove adhering air bubbles. After the treatment period, during which the samples, if appropriate, had also been swirled about in the liquid, the centrifugation proper was carried out by means of a laboratory centrifuge made by Messrs. Heraeus Christ GmbH, model UJO. The containers and samples were in each case centrifuged for 30 minutes at 4000 rpm. The distance of the gauzes in the beakers from the axis of the centrifuge was in each case 8.5 cm. Subsequently, the centrifuged fiber samples were weighed and then dried to constant weight in a drying cabinet at 120° C. The weight difference between the moist and the dried sample, divided by the dry weight, is indicated below, in %, as the water retention or liquid retention.

| Example | textile properties | | | | Liquid retention | |
|---|---|---|---|---|---|---|
| | yarns | | single filaments | | | |
| | denier (dtex) | tensile strength (cN/tex) | denier (dtex) | knot strength (cN/tex) | % water | 0.1 N NaOH |
| 1 | 967 | 12 | 3.2 | 11 | 57 | 2540* |
| 2 | 996 | 19 | 3.3 | 9 | 37 | 1375 |
| 3 | 1020 | 20 | 3.4 | 9 | 33 | 850 |
| 4 | 978 | 29 | 3.3 | 8 | 22 | 650 |
| 6 (comparison) | 840 | 40 | 2.8 | 14 | 13 | 10 |

*weight: 100 mg

EXAMPLE 7

The polymer resulting from Example 3 was dissolved at 80° C. to form a 29% strength spinning solution and was force at a feed rate of 36 ml/min through a 50-hole-jet, hole diameter 0.15 mm, into a dry spinning cell. A 320° C. inert gas was blown into the cell in the yarn direction, the walling of the cell having been heated to 200° C. The filaments were drawn out of the spinning cell at a speed of 220 m/min, in each case two of these filaments were plyed and washed with water at 50° C. under a light tension. The filaments were dried, accompanied by a small amount of stretching, on two duos which had been heated to 140° and 190° C. and were drawn off the second duo with a stretching ratio of 1:2.1. The overall stretching ratio was 1:3.0. Subsequently, the yarn was allowed to shrink by 15% in a hot-air channel at 180° C. The single filaments so obtained exhibited the following properties: denier: 3.2 dtex, tensile strength: 21 cN/tex, elongation at break: 30%, knot strength: 10 cN/tex, water retention: 29%, liquid retention in 0.1N NaOH: 788%.

The fibers obtained according to Examples 2, 3, 4 and 7 could also be processed, in the crimped state, into waddings and worsted yarns.

We claim:

1. A method for making a fiber or filament of a swellable polymer of high tensile strength, which method comprises spinning a polymeric raw material into a fiber or filament wherein said polymeric raw material is produced by agitating a suspension of solid particles of an acrylonitrile polymer, formed from acrylonitrile units and other units copolymerizable therewith, in dilute aqueous sulfuric acid until said polymer is hydrolyzed to an extent that it contains from 10 to 30 percent by weight of carboxyl groups, said dilute aqueous sulfuric acid having an acid concentration between 40 to 50 percent by weight such that sticking of individual particles of said polymer to one another is avoided.

2. A method as in claim 1 wherein said suspension is agitated at its boiling point.

3. A method as in claim 1 wherein said acrylonitrile polymer is hydrolyzed to an extent that the resulting polymeric raw material contains from 15 to 26 percent by weight of carboxyl groups.

4. A method as in claim 1 wherein said acrylonitrile polymer is a terpolymer of acrylonitrile, methyl acrylate, and methacrylsulfonate.

5. A method as in claim 1 wherein said acid is sulfuric acid of 45 to 49 percent concentration by weight.

* * * * *